United States Patent [19]

Studebaker et al.

[11] 4,176,882

[45] Dec. 4, 1979

[54] IN SITU OIL SHALE RETORTS WITH GAS BARRIERS FOR MAXIMIZING PRODUCT RECOVERY

[75] Inventors: Irving G. Studebaker; Ned M. Hutchins, both of Grand Junction, Colo.

[73] Assignee: Occidental Oil Shale, Inc., Grand Junction, Colo.

[21] Appl. No.: 878,387

[22] Filed: Feb. 16, 1978

[51] Int. Cl.[2] ..... E21C 41/10

[52] U.S. Cl. ..... 299/2; 299/19

[58] Field of Search ..... 299/2, 19

[56] References Cited

U.S. PATENT DOCUMENTS

| | | | |
|---|---|---|---|
| 1,913,395 | 6/1933 | Karrick | 299/2 |
| 1,919,636 | 7/1933 | Karrick | 299/2 |
| 3,950,029 | 4/1976 | Timmins | 299/2 |
| 4,025,115 | 5/1977 | French et al. | 299/2 |
| 4,045,085 | 8/1977 | Garrett | 299/2 |
| 4,047,760 | 9/1977 | Ridley | 299/2 |

OTHER PUBLICATIONS

"In situ Oil Shale-Resource Recovery" by H. E. McCarthy, American Chemical Soc. Meeting, 8-31-76.

Synthetic Fuels, pp. 2-21 to 2-24, Jun. 1975.

*Primary Examiner*—Ernest R. Purser

*Attorney, Agent, or Firm*—Christie, Parker & Hale

[57] ABSTRACT

A group of spaced apart in situ oil shale retorts is formed in a subterranean formation containing oil shale. At least one void is excavated in each retort site, and remaining formation within each retort site is explosively expanded toward such a void for forming a fragmented permeable mass of formation particles containing oil shale in each retort. A vertically extending partition of substantially unfragmented formation forms a gas barrier between the fragmented masses in a pair of adjacent retorts. Such a gas barrier yields structurally but retains sufficient integrity to inhibit gas flow between the fragmented masses of adjacent retorts. Such a gas barrier is sufficiently thin that it independently supports substantially the same proportionate amount of load from overburden at elevations above the retorts as the fragmented masses on either side of the gas barrier. Subsidence of such a gas barrier is substantially the same as subsidence of adjacent fragmented masses, permitting uniform subsidence of overburden.

61 Claims, 3 Drawing Figures

IN SITU OIL SHALE RETORTS WITH GAS BARRIERS FOR MAXIMIZING PRODUCT RECOVERY

BACKGROUND

This invention relates to in situ recovery of shale oil, and more particularly to techniques for maximizing the recovery of shale oil from a subterranean formation containing oil shale.

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which, upon heating, decomposes to produce liquid and gaseous products. It is the formaton containing kerogen that is called "oil shale" herein, and the liquid hydrocarbon product is called "shale oil".

A number of methods have been proposed for processing the oil shale which involve either first mining the kerogen-bearing shale and processing the shale on the surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597 and 4,043,598, which are incorporated herein by this reference. Such patents describe in situ recovery of liquid and gaseous hydrocarbon materials from a subterranean formation containing oil shale by fragmenting such formation to form a stationary, fragmented permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing retorted oil shale.

One method of supplying hot retorting gases used for converting kerogen contained in the oil shale, as described in U.S. Pat. No. 3,661,423, includes establishment of a combustion zone in the retort and introduction of an oxygen-containing retort inlet mixture into the retort as an oxygen-supplying gaseous combustion zone feed to advance the combustion zone through the retort. In the combustion zone, oxygen in the combustion zone feed is depleted by reaction with hot carbonaceous materials to produce heat, combustion gas, and combusted oil shale. By the continued introduction of the retort inlet mixture into the retort, the combustion zone is advanced through the fragmented mass in the retort.

The combustion gas and the portion of the combustion zone feed that does not take part in the combustion process pass through the fragmented mass in the retort on the advancing side of the combustion zone to heat the oil shale in a retorting zone to a temperature sufficient to produce kerogen decomposition, called retorting, in the oil shale to gaseous and liquid hydrocarbon products, and to a residual solid carbonaceous material.

The liquid products and gaseous products are cooled by the cooler oil shale fragmented in the retort on the advancing side of the retorting zone. The liquid hydrocarbon products, together with water produced in or added to the retort, are collected at the bottom of the retort. An off gas containing combustion gas, including carbon dioxide generated in the combustion zone, gaseous products produced in the retorting zone, carbon dioxide from carbonate decomposition, and any gaseous retort inlet mixture that does not take part in the combustion process, is also withdrawn from the bottom of the retort. The products of retorting are referred to herein as liquid and gaseous products.

Residual carbonaceous material in the retorted oil shale can be used as fuel for advancing the combustion zone through the retorted oil shale. When the residual carbonaceous material is heated to its spontaneous ignition temperature, it reacts with oxygen. As the residual carbonaceous material becomes depleted in the combustion process, the oxygen penetrates farther into the oil shale retort where it combines with remaining unoxidized residual carbonaceous material, thereby causing the combustion zone to advance through the fragmented oil shale.

It is desirable to maximize the amount of oil shale subjected to retorting within a region of formation being developed. To this end it is desirable to minimize the amount of formation excavated from each retort site when forming void volumes in preparation for explosive expansion. The mined out formation is excluded from the in situ retorting process, which can reduce the overall recovery of shale oil from the retorts. Removed formaton either must be retorted by above ground techniques, or the shale oil is lost when the mined out material is discarded. Moreover, the steps of mining the shale and transporting it to above ground are expensive and time consuming.

When forming a group or cluster of in situ retorts, substantial amounts of unfragmented formation are left in the vertical partitions or barriers between adjacent fragmented masses in the group of retorts. The partitions or barriers between individual retorts contain essentially unrecoverable shale oil, but such barriers are left in place because they serve as gas barriers which make it possible to independently control retorting operations in each fragmented mass within the group of retorts, and they substantially prevent leakage of off gas into adjacent underground workings where operating personnel may be present. In the past it has been considered desirable to have barriers strong enough to provide substantial support for overburden at elevations above the retorts to minimize load on the fragmented mass and minimize subsidence.

During retorting, a substantial amount of the kerogen present in the walls of unfragmented formation which provide such gas barriers is not retorted. Therefore, to maximize the yield from a group of in situ retorts, it is desirable to form gas barriers which are as thin as possible so they contain the least practical amount of kerogen while still being sufficiently thick that they can inhibit the flow of gases between adjacent retorts.

The thickness of gas barriers left between retorts also can affect subsidence control of the unfragmented formation or overburden above a group of retorts. When load from the overburden is applied to the fragmented masses following explosive expansion, some crushing of the particles at the particle interfaces occurs, which can result in subsidence of formation above the fragmented masses. If the gas barriers between retorts have sufficient structural strength to support the overburden, while limited support of the overburden is provided by adjacent fragmented masses, the result can be an abrupt change in subsidence between a region of completely supported formation and an adjacent region where subsidence occurs. Such an abrupt change can cause the formation to rupture along a shear plane laying in the same plane as the surface of a gas barrier and extending upwardly from the top of the fragmented mass toward the ground surface. Rupture of formation along such a shear plane is to be avoided because it can cause leakage of water from overlying aquifers into retort or mining areas, leakage of gas from completed retorts, leakage of air into retorts during retorting operations, and safety hazards in underground workings containing operating personnel.

Thus, it is desirable to leave gas barriers between fragmented masses in a group of in situ oil shale retorts so that good product yield can be provided while ensuring that the gas barriers are effective in isolating retorting operations in adjoining retorts. It is also desirable to avoid abrupt changes in subsidence of overburden above the group of retorts.

SUMMARY OF THE INVENTION

A group of spaced apart in situ oil shale retorts is formed in a subterranean formation containing oil shale. Each retort in the group contains a fragmented permeable mass of formation particles containing oil shale. The fragmented masses in adjacent in situ retorts are spaced apart by a gas barrier in the form of a vertically extending partition of substantially unfragmented formation which is sufficiently thick to inhibit substantial gas flow between the fragmented masses of such adjacent retorts. The partition of unfragmented formation is sufficiently thin that it independently supports substantially the same load from the overburden at elevations above the retorts as the load supported by the fragmented masses in the adjacent retorts.

In a preferred method for forming each fragmented mass, at least one void is excavated in each retort site, and remaining formation within each retort site is explosively expanded toward such a void for forming a fragmented permeable mass of formation particles containing oil shale in each in situ retort. Explosive is placed in a plurality of mutually spaced apart blasting holes in such remaining unfragmented formation within such a retort site adjacent such a void. Such explosive is detonated to form such a fragmented mass. The gas barrier left between adjacent fragmented masses has a minimum thickness of more than the burden distance or the spacing distance of explosive in the blasting holes. Such a partition has a thickness sufficiently greater than the spacing of natural cleavage planes in the formation to avoid substantial fracture through a partition.

DRAWINGS

Features of specific embodiments of the best mode contemplated for carrying out the invention are illustrated in the drawings, in which:

FIG. 1 is a fragmentary, semi-schematic, cross-sectional side view showing a subterranean formation containing oil shale in preparation for forming a group of in situ oil shale retorts according to principles of this invention;

FIG. 2 is a fragmentary, semi-schematic, cross-sectional top view taken on line 2—2 of FIG. 1 and showing a group of in situ retorts with gas barriers between the fragmented masses of the adjacent retorts, and FIG. 3 is a fragmentary, semi-schematic, cross-sectional side view showing a pair of adjacent completed in situ oil shale retorts separated by a gas barrier according to principles of this invention.

DETAILED DESCRIPTION

Figure 1:
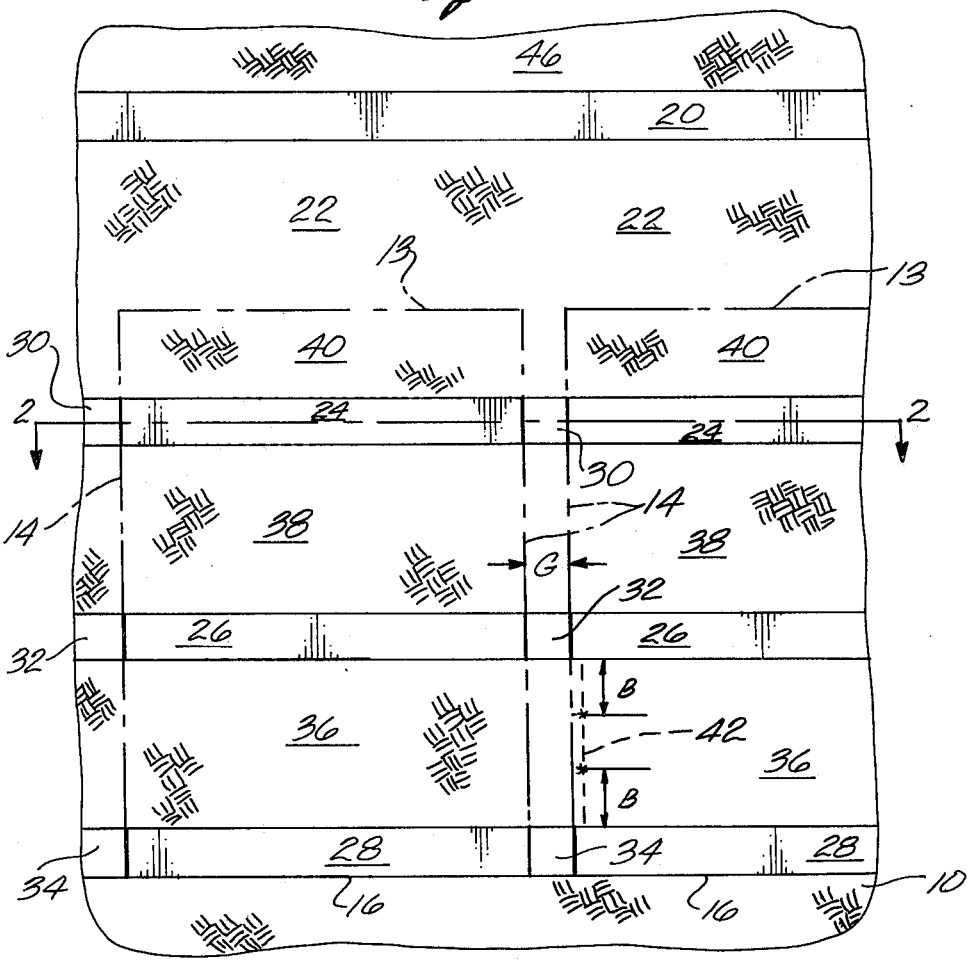

Referring to the drawings, a system of in situ oil shale retorts is formed in a subterranean formation 10 containing oil shale. Each retort, when completed by explosive expansion techniques, comprises a fragmented permeable mass 11 of formation particles containing oil shale having top, bottom and side boundaries. In one embodiment, the retorts are horizontally spaced apart in parallel rows, leaving vertically extending partitions or gas barriers 12 of substantially unfragmented formation between the fragmented masses in adjacent in situ retorts. Such vertical partitions or walls 12 of substantially unfragmented formation separate fragmented masses 11 within a given row from one another, as well as separating each fragmented mass in one row from a corresponding fragmented mass in an adjacent row. The vertical partitions of substantially unfragmented formation provide gas barriers for isolating retorting operations in the respective fragmented masses 11 from one another.

FIG. 1 illustrates schematically in vertical cross section a pair of adjacent in situ oil shale retort sites at a stage of preparation prior to explosive expansion for forming each fragmented mass 11. The in situ retorts being formed are rectangular in horizontal cross section, and as shown in phantom lines in FIG. 1, each retort being formed has a horizontal top boundary 13, four vertically extending side boundaries 14, and a horizontal lower boundary 16. An air level drift 20 is excavated on an upper working level above the retort sites. The floor of the air level drift 20 is spaced above the upper boundary 13 of the retorts being formed, leaving a horizontal sill pillar 22 of unfragmented formation between the bottom of the air level drift 20 and the upper boundary 13 of the retorts being formed. The horizontal extent of the drift 20 and other workings on the air level is related to the horizontal cross section of the retorts being formed so that the air level workings can provide a base of operation for providing effective access to substantially the entire horizontal cross section of each retort being formed. Such a base of operation provides access for subsequently explosively expanding formation toward one or more voids formed within each retort site. The base of operation also facilitates introduction of oxygen supplying gas into the top of the fragmented mass 11 formed below the horizontal sill pillar 22 by explosive expansion.

In preparing each retort, formation from within the boundaries of each retort site is excavated to form at least one void, leaving a remaining portion of unfragmented formation within the boundaries of the retort being formed. The remaining portion of unfragmented formation is explosively expanded toward such a void to form the fragmented permeable mass 11 of formation particles containing oil shale in the retort.

In the embodiment illustrated in FIG. 1, three vertically spaced apart, parallel horizontal voids are formed within each retort site. A rectangular upper void 24 is excavated at an upper retort access level, a rectangular intermediate horizontal void 26 is excavated at an intermediate retort access level, and a rectangular lower horizontal void 28 is excavated at a lower retort access level. The horizontal cross section of each horizontal void is substantially similar to that of the retort being formed. The horizontal voids can include pillars of unfragmented formation for roof support, if desired. The pillars are not shown in the drawings for simplicity. In the embodiment shown, a separate retort level access drift extends through opposite side boundaries of the retort site at the elevation of each horizontal void, and each of such access drifts can be centered in its respective horizontal void. Thus, an upper level retort access drift 30 extends through opposite side walls of the upper level void 24, an intermediate level retort access drift 32 opens through opposite side walls of the intermediate level void 26, and a lower level retort access drift 34 opens through opposite side walls of the lower level void 28. Such drifts provide access for mining equipment used for excavating such voids. A variety of such access arrangements can be used.

The lower horizontal void 28 is formed at or near the bottom of the retort being formed, and the intermediate horizontal void 26 is spaced above the lower void 28, leaving a lower zone 36 of unfragmented formation between the lower and intermediate voids. Similarly, the upper horizontal void 24 is formed above the intermediate void 26, leaving an intermediate zone 38 of unfragmented formation between the upper and intermediate voids. An upper zone 40 of unfragmented formation remains between the top of the upper void 24 and the top boundary 13 of the fragmented mass being formed.

In a working embodiment, each retort is about 400 feet long by about 150 feet wide in horizontal cross section. The height of each retort is about 300 to 400 feet, and each horizontal void has a height of about 34 feet with pillars left in each void for temporary support. The retorts are formed so that their long axes are parallel to the elongate extent of each row of spaced apart retorts, as illustrated best in FIG. 2.

The surfaces of unfragmented formation in the zones 36 ad 38, for example, between the horizontal voids 24, 26, 28 provide horizontal free faces toward which formation is explosively expanded for forming a fragmented permeable mass 11 of formation particles containing oil shale in each in situ retort. Further details of techniques for forming retorts using such horizontal void volumes are more fully described in U.S. Pat. Nos. 4,043,597 and 4,043,598, and U.S. patent application Ser. No. 815,799 entitled METHOD OF FORMING IN SITU OIL SHALE RETORTS, filed July 15, 1977 now U.S. Pat. No. 4,106,814. These patents and this application are assigned to the same assignee as this application and are incorporated herein by this reference.

After completing a set of upper, intermediate and lower voids in a retort site, a plurality of mutually spaced apart vertical blasting holes 42 are drilled in the upper, intermediate and lower zones 40, 38 and 36, respectively, of unfragmented formation adjacent the horizontal voids. In embodiments where pillars of unfragmented formation are left in the voids, blasting holes are also drilled in the pillars. The blasting holes 42 are loaded with explosive which is detonated in a single round for explosively expanding the zones of unfragmented formation toward the horizontal free faces of formation adjacent the horizontal voids. In a working embodiment, the horizontal voids for many or all retort sites in a given row are initially formed, and explosive in each retort site is detonated in a sequence so as to form one retort at a time in such a row, advancing from one end of the row to the other. In the embodiment shown in FIG. 2, for example, blasting is advancing to the left, one retort at a time.

Alternatively, the in situ retorts can be formed by excavating at least one columnar void, preferably in the form of a vertical slot (not shown) for providing vertical free faces of formation on opposite sides of the slot in each retort site. Blasting holes are drilled in unfragmented formation adjacent the vertical slot and parallel to such a free face. Explosive in the blasting holes is detonated to explosively expand formation adjacent the slot toward the vertical free faces to form a fragmented permeable mass of formation partilces containing oil shale within the in situ retort being formed. Further details of techniques for forming a fragmented mass employing a columnar void are disclosed in aforementioned U.S. Pat. Nos. 4,043,595 and 4,043,596.

Referring again to FIGS. 2 and 3, explosive expansion for forming each fragmented mass 11 leaves vertically extending partitions of unfragmented formation or gas barriers 12 between adjacent fragmented masses 11 in the group of retorts being formed. The gas barriers have a thickness (in horizontal cross section) represented by the dimension G. The gas barriers are left between each adjacent pair of fragmented masses in a given row of retorts, as well as between each corresponding pair of fragmented masses in adjacent rows, and the horizontal cross-sectional thickness of all gas barriers is about the same.

At the bottom of each fragmented mass a transition section 52 of fragmented formation extends between the principal portion of the fragmented mass and a stub drift (not shown) connecting to the production level drift 18 to provide a fluid flow path for off gas and liquid products. Following the explosive expansion step for forming each fragmented mass 11, separate substantially impermeable barriers (not shown) are formed in the upper, intermediate, and lower level retort access drifts 30, 32 and 34, respectively, to plug the openings through the gas barriers 12 between retorts for inhibiting gas flow between adjacent fragmented masses during subsequent retorting operations. One technique for forming such gas impermeable barriers is disclosed in U.S. Pat. No. 4,106,814, and referred to above.

After explosive expansion for forming the fragmented masses, load from the overburden 46 at elevations above the fragmented masses 11 is carried in part by the fragmented masses. In a working embodiment the overburden is about 500 to 2000 feet in depth, and in one specific example about 1200 feet. When the load of the overburden is applied to the fragmented masses, crushing of the particles at particle interfaces occurs, which can cause subsidence of formation resting on the fragmented masses. It has been estimated, for example, that a fragmented mass about 300 feet high at an overburden depth of about 1200 feet will have a subsidence of about three to nine feet which is insignificant in unoccupied land since, in practice of this invention, subsidence is uniform over a large area and does not disrupt the ground surface.

According to the present invention, the gas barriers 12 are formed so they yield structurally about the same as the fragmented masses under loads of the overburden 46, without substantial fragmenting, so that the gas barriers 12 support proportionately about the same amount of the load from the overburden as is supported by the fragmented masses 11. By proportionately the same amount of load is meant that the average amount of overburden load, per unit of horizontal cross-sectional area, supported by the gas barriers is substantially the same as the average load, per unit of area, supported by the fragmented masses. In a working embodiment, about 75 to 80% of the area within an in situ retort development region is in the fragmented masses 11, and about 20 to 25% of the same area is in the gas barriers 12. In this instance, the fragmented masses support about 75 to 80% of the overburden load and the gas barriers support about 20 to 25% of the load.

The gas barriers can yield structurally since they are formed to have a selected wall thickness. By appropriate excavation of voids and placement of explosive in the retort sites, explosive expansion leaves gas barriers which are sufficiently thin that they will not provide a substantially greater proportionate amount of support for the overburden load than the support provided by the fragmented masses. Some load from the overburden 46 can be transferred from the area occupied by the fragmented masses to the gas barriers, but the gas barriers are not so thin that they will fail structurally under the load of the overburden. Complete structural failure of the gas barriers is prevented by lateral support from the fragmented masses. The gas barriers are sufficiently thick that they will yield structurally, without substantial fragmenting so that upon subsidence of the overburden the gas barriers remain sufficiently unfragmented to inhibit substantial gas flow between adjacent fragmented masses. "Fragmenting" and "fracturing" should be distinguished. When the oil shale is fragmented, it is broken into individual pieces and moved an appreciable distance from its original location. Many of the pieces also change orientation somewhat or are displaced relative to adjacent pieces so that the particles occupy considerably more volume than the unfragmented rock due to the volume of the void spaces between particles. When oil shale is fractured small fissures are produced and there may be some displacement of the pieces of oil shale to accommodate the relatively small void volume in these fissures. The particles change orientation only slightly, if at all, so that the fissures have relatively small void volume.

The void fraction in a fragmented mass of oil shale is ordinarily more than about ten percent and often more than about twenty percent. Thus, for example, the volume of a fragmented mass having a void fraction of twenty percent is occupied by 80% particles of the fragmented formation and 20% void spaces between such particles.

The partitions between adjacent fragmented masses are sufficiently thin that they yield inelastically under the loads imposed by the overburden. As the partitions yield they decrease in height and dilate in thickness, causing some deformation in the adjacent fragmented masses. These fragmented masses provide lateral support for such partitions, preventing complete structural failure, but the degree of lateral support is less than from virgin formation and permits deformation of the partition. As such a partition inelastically deforms, fractures are formed and translation can occur along such fractures. It is believed that a principal part of the partition deformation is accounted for by reason of formation of and movement along such fractures. Such fracturing does not induce appreciable gas permeability through such a partition.

Oil shale often contains about ½% void space in its natural state. The fracturing can result in some increase in void space, however, it is believed that the void space in yielded partitions as herein provided between fragmented masses remains less than about 1%. The gas flow resistance through such a partition is very much greater than the gas flow resistance through such a fragmented mass which has a void fraction of 20% or more. Such a partition which has structurally yielded remains substantially impermeable to gas flow between adjacent fragmented masses.

Such a partition that has yielded structurally is considered to be substantially unfragmented even though some translation along fractures has occurred. Relative rotation is infinitesimal and no appreciable void space occurs in the partition. Such a partition is fractured in response to the dead load of overburden and possibly in part due to dynamic loads during explosive expansion to form a fragmented mass of particles in an adjacent in situ oil shale retort. There is, however, no substantial fragmenting of such a partition. It is significant to note that such a partition has appreciable triaxial compressive stress and fractures formed in such a partition tend to be pressed closed over much of their extent.

Such a partition is thin and tall; for example, in one embodiment about 30 feet thick and about 300 feet high. If such a pillar had no lateral support from the adjacent fragmented masses it would fail structurally in buckling and/or shear and be completely fragmented. With such a tall, thin partition the subsidence of the top under overburden loads causes minimal lateral dilation and consequent deformation of adjacent fragmented masses. The limited lateral deformation is readily accommodated in small fractures and limited translation so that the partition remains substantially unfragmented.

The gas barriers are not sufficiently thick that they can independently support the entire load from the overburden at elevations above the retorts following explosive expansion of adjacent fragmented masses. By yielding structurally, rather than remaining intact or undisturbed, the gas barriers are able to share the overburden load with the fragmented masses. Although the gas barriers yield structurally, they are sufficiently thick that they will remain substantially unfragmented for a time interval at least as long as the active life of the retorts on opposite sides of the barrier.

The gas barriers can yield to the extent that there is a small amount of subsidence of formation directly above the gas barriers. This small amount of subsidence can be less than the amount of subsidence of the overburden directly above the fragmented masses on opposite sides of the gas barrier. Such a difference in amount of subsidence, if any, is small and is limited by making the partitions thin so that the overburden on opposite sides of the gas barrier can flex, rather than rupture, under such a difference in subsidence. That is, the partitions are sufficiently thin in relation to their height that the subsidence of the upper portion of such a partition is substantially the same as subsidence of the upper portion of adjacent fragmented masses. This avoids abrupt changes in subsidence of overburden above the retorts which, in turn, prevents rupture of fracturing of the overburden along a shear plane through the overburden above the gas barriers. In effect the overburden above the area of retort development can subside monolithically or as a single unit rather than breaking into smaller units which could subside by different amounts. By avoiding rupture of the overburden above the juncture between the fragmented masses and the gas barriers, several potential problems are avoided, including leakage of water from overlying aquifers into retort and mining areas, leakage of gas from spent retorts, leakage of air into retorts being processed, and safety hazards in underground workings. Impermeability of the partitions is retained by having the thickness greater than the spacing between natural cleavage planes in the formation. A number of formations containing oil shale have horizontal cleavage planes extending substantially parallel to the lower boundary of the formation, as well as generally vertical cleavage planes extending substantially perpendicular to the lower boundary of the formation. Vertical cleavage planes often occur in sets, with individual cleavage planes within a given set being generally parallel to one another. There are generally two or three sets of vertical cleavage planes extending through formations containing oil shale, with one set of vertical cleavage planes intersecting another set.

The formation breaks much easier along the cleavage planes than along other planes extending through the formation. Cleavage plane is defined in *A Dictionary of Mining, Mineral and Related Terms,* U.S. Dept. of Interior, 1968, as "any uniform joint, crack or change in quality of formation along which rock will break easily when dug or blasted." For example, when formation is excavated to form a drift in oil shale, formation at the side walls of the drift tend to break along the vertical cleavage planes.

The cleavage planes of subterranean formations containing oil shale are natural secondary structures which allow the formation to be more easily split along the cleavage planes than along other planes.

Cleavage planes are not always visible in a formation containing oil shale. They are merely planes of weakness along which the formation has a lower strength than in planes extending in other directions. It therefore takes less stress to fracture the formation along the cleavage planes, and most fractures induced in the formation are aligned with the cleavage plane sets.

The cleavage planes within a given cleavage plane set are closely spaced through the formation from inches to several feet apart. For example, in an extensive oil shale formation in the Piceance Basin of Colorado, one cleavage plane set is almost horizontal and extends parallel to the lower boundary of the formation and two other cleavage plane sets are almost vertical and extend substantially perpendicular to the lower boundary of the formation. The dip of these formations is almost entirely less than about 3 degrees, although the areas with a higher dip are known. Dip is the angle at which a cleavage plane is inclined from the horizontal. It is perpendicular to strike which is the direction or bearing of a horizontal line in the plane of an inclined structural feature. The vertical cleavage planes can, therefore, tilt slightly, but are substantially vertical.

The principal directions and spacings of the cleavage planes can be determined by statistical analysis as mining is conducted. Thus, for example, as a drift is excavated from an outcropping into a subterranean formation containing oil shale, the walls of the drift have rock protrusions, many of which have substantially planar faces. The azimuth and locus of a number of these planar faces is determined, and it is found through statistical analyses that the greater number of such faces are aligned with cleavage planes of the formation. The principal cleavage planes also can be determined by surface mapping of cleavages in outcroppings, or by analyses of core samples.

The actual cleavage planes in the formation are not precisely parallel with each other. There is some angular dispersion of cleavage planes from the nominal dip and strike of such a cleavage plane set. The individual cleavage planes in that set can have a strike within a band extending about thirty degrees or so on each side of the nominal strike of the cleavage plane set. Similarly, there can be dispersion in the dip of cleavage planes in a cleavage plane set. Additional cleavage planes almost randomly spaced and oriented can be found between cleavage plane sets.

When two or more vertically extending cleavage plane sets are present in a formation, one can be designated as a principal cleavage plane set or fracture set and the other as a secondary cleavage plane or fracture set. A third minor cleavage plane set is sometimes found in oil shale formations. The principal cleavage plane set is characterized by a relatively larger number and/or extent of fractures as compared with the number and/or extent of fractures in the secondary cleavage plane set.

In the Piceance Basin most of the cleavage planes are spaced apart less than a couple of feet. It is believed that about $\frac{3}{4}$ of the cleavage planes have a spacing of less than about seven to ten feet. Preferably the partitions between fragmented masses are appreciably thicker than the spacing of most of the cleavage planes in the formation so that intercommunicating fractures in the partitions after yielding are minimized. This results in gas barriers having permeability appreciably more than an order of magnitude lower than the permeability of the fragmented masses. Such a barrier substantially inhibits gas flow between adjacent fragmented masses. For assuring adequate thickness to avoid appreciable gas flow it is preferred that the gas barriers be at least about 50% thicker than the maximum spacing of about $\frac{3}{4}$ of the cleavage planes. That is, for example, if it is found that about $\frac{3}{4}$ of the cleavage planes in the formation are spaced apart less than about ten feet, the partition should be at least about 15 feet thick. With such a minimum thickness only rarely will large cleavage planes have sufficient length to extend through the gas barrier. Such an occasional fracture does not increase gas permeability of the partition enough to disturb retorting operation in adjacent fragmented masses.

The spacing between cleavage planes in the formation does not directly affect gas flow through the gas barriers. Spacing does, however, give an indication of the extent of cleavage planes and hence the likelihood of fractures opening up appreciable gas flow paths through the partitions between retorts. When the spacing between cleavage planes is great, the extent of fracture along a cleavage plan is generally greater than when the spacing is small. There can be two reasons for this, displacement and stress. Inelastic deformation of such a partition involves lateral dilation and vertical shrinkage of the partition. Such dimensional changes are at least in part accommodated in fractures along which relative displacements occur. When cleavage planes along which fractures preferentially occur are widely spaced, a given displacement of the partition requires a more extensive fracture than the many smaller fractures that occur when cleavage planes are closely spaced. A corollary of this is the stress applied at fracture sites with large and small cleavage plane spacings. Yielding is believed to occur in a "weak link" mode with fractures occuring along such cleavage planes. With large spacing there is a greater stress concentration than with small spacing. This contributes to extensive fractures at widely spaced cleavage planes.

The direct effect on permeability of the gas barriers is related to the extent of fracture along cleavage planes. This extent is very difficult to observe since a crack disappearing into a drift wall, for example, has a length that is almost indeterminate. The spacing between fractures can, however, be directly observed in excavations. For such reasons as the ease of determining spacing of cleavage planes, the tendency of extent of fracture of correlate directly with spacing, and the relation between resistance to gas flow through a partition to the extent of fractures, the thickness of the partitions can be related to the cleavage plane spacing. Thus, the gas barrier thickness should be at least 1.5 times a selected distance wherein at least about ¾ of the cleavage planes are spaced apart less than the selected distance. Such a minimum thickness reduces the likelihood of a fracture penetrating the partition to a very small quantity and assures that the partition is an effective gas barrier for inhibiting gas flow between adjacent fragmented masses.

The thickness of the gas barriers is controlled by excavation of the voids 24, 26, 28 and placement of explosive in the zones 36, 38, 40 of unfragmented formation within the retort site. The gas barriers have a minimum thickness of more than the burden distance or the spacing distance of explosive in the blasting holes prior to explosive expansion.

Burden distance is the distance between the centroid of and explosive charge and the nearest free face of formation to be explosively expanded by the explosive charge. The burden distance of the explosive is illustrated in FIG. 1 which illustrates one of the blasting holes 42 drilled in the lower zone 36 of unfragmented formation. In the working embodiment shown in FIG. 1, the zone of unfragmented formation 36 is about 70 feet thick and the blasting hole 42 is drilled downwardly to a depth of about 52 feet below the floor of the intermediate void. The lower 34 feet of the blasting hole is loaded with explosive and the upper 18 feet of the blasting hole 42 is stemmed with inert material.

The true centroid of the explosive in the blasting hole 42 is thus midway between the two free faces at the floor of the intermediate void 26 and the roof of the lower void 28, respectively. Formation in the zone 36 of unfragmented formation can explosively expand symmetrically towards these two free faces. In effect, therefore, the column charge in the blasting hole is like two equal charges, the upper one causing formation to expand towards the upper free face and the lower one expanding formation toward the lower free face. Thus, the charge can be considered to have two effective centroids, each located half way between the center of the column charge and one of the ends thereof. In this instance, the burden distance for explosive in the top half of the zone of unfragmented formation 36 is equal to about 26.5 feet, and the burden distance is the same for explosive in the bottom half of the same zone of unfragmented formation. The burden distance is identified by the dimension B in FIG. 1.

Figure 2:
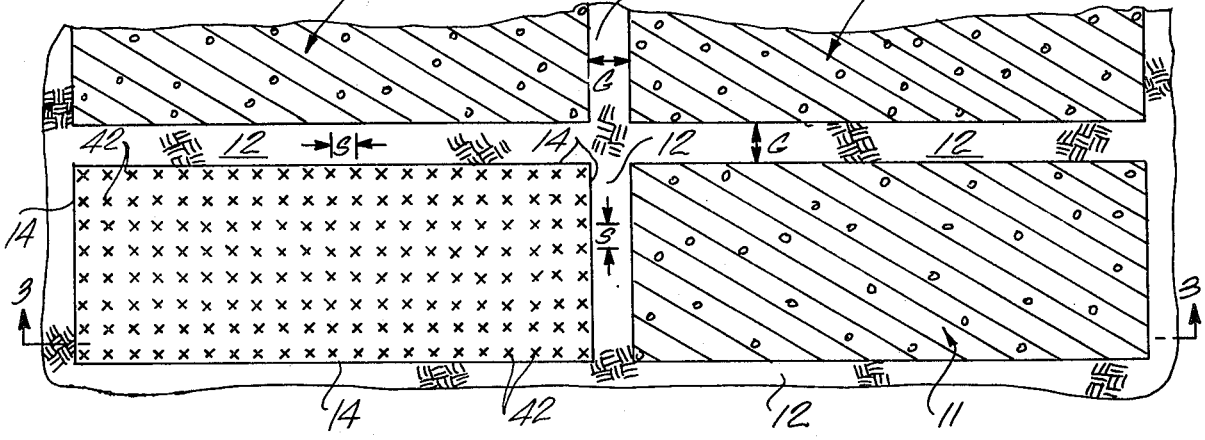
Figure 3:
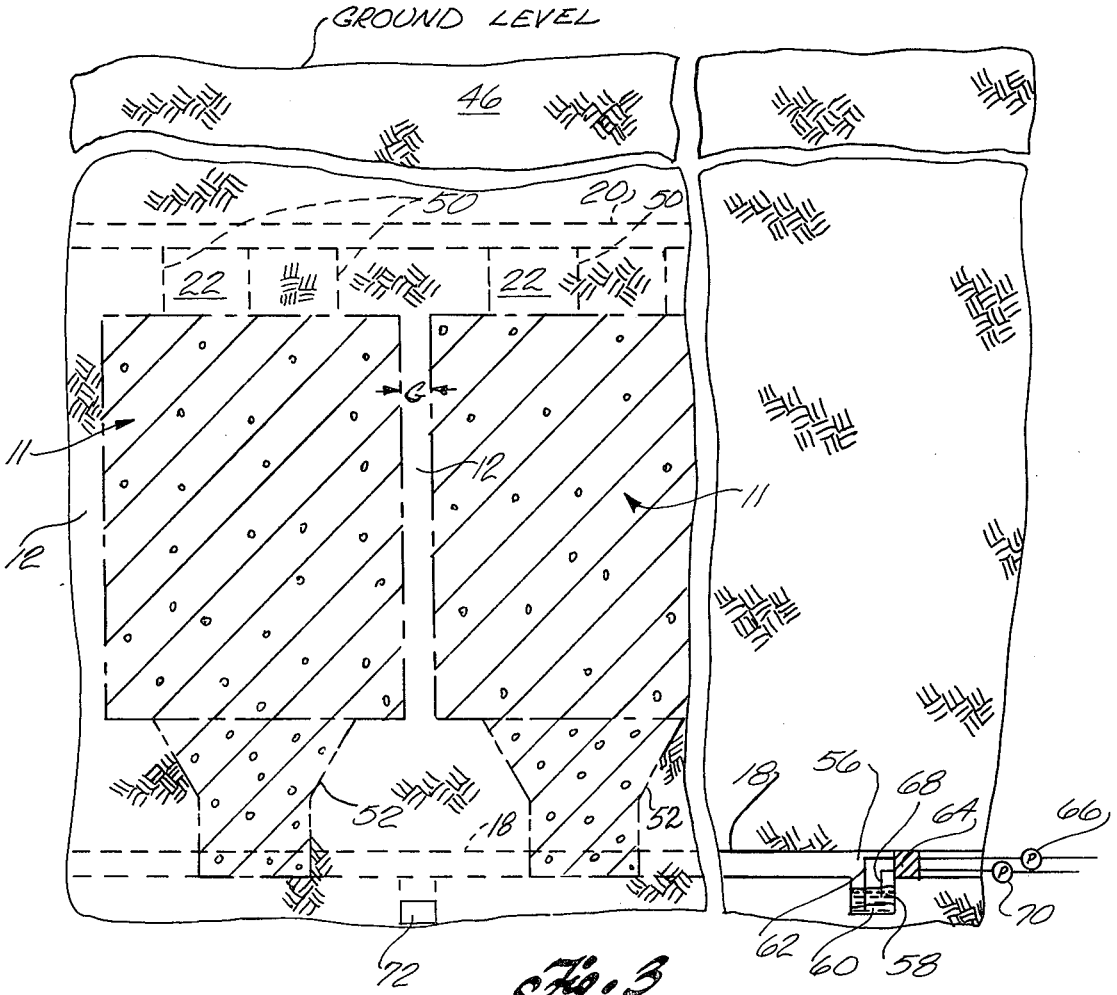

The spacing distance is the distance between adjacent blasting holes in a direction parallel to the free face. FIG. 2 shows a working embodiment having eight parallel rows of blasting holes 48. In this embodiment there are 21 equidistantly spaced apart blasting holes shown in each row, although the number of holes and the pattern of the holes can vary. The spacing distance is identified by the dimension S in FIG. 2, and in a working embodiment the spacing distance between holes is about 20 feet.

In an alternate method for forming a fragmented mass, wherein formation is explosively expanded toward a vertical columnar void (not shown) vertical blasting holes can be drilled parallel to the free face of formation adjacent the vertical columnar void. The burden distance is the horizontal distance from the vertical free face of unfragmented formation adjacent the columnar void to the blasting holes nearest such a vertical free face. The spacing distance is the distance between adjacent holes in a direction parallel to the free face. It can be desirable in some techniques for forming a retort to have a plurality of rows of blasting holes parallel to a vertically extending free face. Thus, for example, in one embodiment wherein the columnar void is in the form of a vertically extending slot the burden distance for a first row of vertical blasting holes can be about 25 feet and the spacing distance about 30 feet; that is, the row of blasting holes is about 25 feet from the free face and there is a spacing distance of about 30 feet between adjacent holes in the row. Another 25 feet from the vertical free face is a second row of vertically extending blasting holes, each spaced about 30 feet from the adjacent hole or holes in the second row. Time delays are used in detonating explosive in such blasting holes so that at least some of the blasting holes in the first row are fired before detonating explosives in holes in the second row further from the original free face. The explosions in the first row cause formation to start expanding and create a new free face extending generally along the first row parallel to the original free face adjacent the slot. The burden distance for the second row is the distance from a blasting hole to the newly created free face. Additional details of burden and spacing in such an embodiment are provided in aforementioned U.S. Pat. Nos. 4,043,595 and 4,043,596.

In a variation of the pattern of blasting holes adjacent a vertically extending slot, relatively large burden and spacing distances can be provided in a row of blasting holes relatively nearer the slot, and an additional row or plurality of rows of blasting holes can be provided farther from the free face and the burden and spacing distances for blasting holes in these rows can be relatively smaller than those in the first row. Thus, for example, the burden and spacing distances in the first row nearest to the free face can be about 25 and 30 feet, respectively, while the burden and spacing distances in the second row can be about 12.5 and 15 feet, respectively; that is, the first row of vertical blasting holes is about 25 feet from the vertical free face and the second row of blasting holes is about 37.5 feet from the original free face. Similar variations in hole location can be provided in forming a fragmented mass where explosive expansion is towards horizontal free faces. Blasting holes nearer a gas barrier between retorts can be closer together than blasting holes further from the gas barrier, for example.

In an embodiment where the blasting holes nearest the gas barrier to be left in place upon explosive expansion have a burden and/or spacing distance different from the burden and/or spacing distances of blasting holes farther from the gas barrier, it is ordinarily the burden or spacing distance of such holes nearest to the gas barrier that should be considered in determining the minimum thickness of gas barrier to be left in place. Thus, the thickness of the gas barrier should be more than the burden distance or spacing distance of blasting holes located closest to the gas barrier.

By selecting the minimum thickness of the gas barriers to be more than the explosive spacing distance or burden distance, formation will fragment, during explosive expansion, toward the void or voids within the retort site, rather than toward an adjacent retort.

The thickness of each gas barrier 12 is preferably in the range of more than one to about 1.5 times the spacing distance or the burden distance. A gas barrier thickness about 1.5 times the burden or spacing distance provides an adequate margin to assure that the barrier remains unfragmented and serves to inhibit substantial gas flow. Greater thickness decreases total recovery of products from the region being developed and can result in gas barriers strong enough that they do not yield structurally under overburden loads. In the working embodiment shown in the drawings, the gas barriers 12 have an average thickness of about 1.5 times the spacing distance of explosive in the explosive placement holes, making the average thickness of the gas barriers about 30 feet. This selected thickness of the gas barriers is produced by placing the outermost row of blasting holes in each zone of unfragmented formation within a given retort site about 30 feet from an adjacent fragmented mass or from a corresponding zone of unfragmented formation in an adjacent retort site.

After the fragmented masses 11 are formed in the group of retorts, the final preparation steps for producing liquid and gaseous products are carried out. These steps include drilling a plurality of feed gas inlet passages 50 downwardly from the air level drift 20 to the top boundary of each fragmented mass so that oxygen containing gas can be supplied to each fragmented mass during retorting operations. Alternatively the upper ends of blasting holes used in forming the fragmented masses can be cleaned and used for introducing gas to the retorts. If desired, instead of providing a transition zone of fragmented formation at the bottom of the retort, a plurality of bore holes or raises can be drilled upwardly from stub drifts adjacent the production level drift 18 to the bottom boundary of each fragmented mass 11 for removal of liquid and gaseous products from the retorts to the production level cross drift 18 below the bottom boundary of the fragmented mass. The drilled inlet passages 50 and product withdrawal passages 52 can be formed before explosive expansion, if desired.

During retorting operations, formation particles at the top of each fragmented mass are ignited to establish a combustion zone at the top of such a fragmented mass. Air or other oxygen supplying gas is introduced to the combustion zone from the air level drift 20 through the sill pillar 22 to the top of the fragmented mass. Air or other oxygen supplying gas introduced to the fragmented mass maintains the combustion zone and advances it downwardly through the fragmented mass. Combustion gas produced in the combustion zone passes through the fragmented mass to establish a retorting zone on the advancing side of the combustion zone wherein kerogen in the fragmented mass is converted to liquid and gaseous products. As the retorting zone moves down through the fragmented mass, liquid and gaseous products are released from the fragemented formation particles. A sump 56 in a portion of the production level drift system away from the fragmented masses collects liquid products, namely shale oil 58 and water 60, produced during operation of the retort. A water withdrawal line 62 extends from near the bottom of the sump out through a sealed opening in a bulkhead 64 sealed across a production level drift. The water withdrawal line is connected to a water pump 66. An oil withdrawal line 68 extends from an intermediate level in the sump out through a sealed opening in the bulkhead and is connected to an oil pump 70. The oil and water pumps can be operated manually or by automatic controls (not shown) to remove shale oil and water separately from the sump. Off gas is withdrawn from the production level drift 18 to a gas collection drift 72 at an elevation lower than the elevation of the production level drift 18. Off gas is withdrawn from the gas collection drift and passed to above ground.

Thus, practice of the present invention provides a system of in situ oil shale retorts separated by gas barriers of substantially unfragmented formation which are sufficiently thin that they yield structurally under loads of the overburden. By structurally yielding, the gas barriers do not support appreciably more than a proportionate amount of the load from the overburden than do the fragmented masses. Such partitions are sufficiently thin that the upper portion of such a partition has a subsidence about the same as the subsidence of the adjacent fragmented masses. This avoids stress concentrations at the partitions and permits uniform subsidence. Thus, rupture of the overburden along shear planes extending upwardly from the boundaries of the fragmented masses is avoided.

Since the gas barriers between fragmented masses are as thin as possible, the total recovery from retorting a group of such retorts can be increased when compared with a group of retorts having much thicker, structurally intact gas barriers. Since the gas barriers between fragmented masses have little, if any, porosity or permeability, recovery of shale oil from such gas barriers is greatly reduced when compared to recovery from fragmented masses. The thinner the gas barriers between adjacent fragmented masses can be made, the greater is the proportion of the oil shale in the region that can be effectively retorted. This is the case since a larger percentage of the total formation containing oil shale is in the fragmented masses and a smaller percentage is in the gas barriers.

What is claimed is:

1. A method of recovering liquid and gaseous products from a plurality of in situ oil shale retorts in a subterranean formation containing oil shale, wherein each retort contains a fragmented permeable mass of formation particles containing oil shale, the method comprising the steps of:

excavating at least one void in each of a plurality of in situ oil shale retort sites, leaving a remaining portion of unfragmented formation within each retort site adjacent such a void;

explosively expanding such a remaining portion of unfragmented formation within each retort site toward such a void for forming a fragmented permeable mass of formation particles containing oil shale in each of a plurality of in situ oil shale retorts;

leaving a gas barrier between the fragmented masses in an adjacent pair of such retorts in the form of a vertically extending partition of substantially unfragmented formation sufficiently thick to inhibit substantial gas flow between the fragmented masses in such adjacent retorts and sufficiently thin that the partition independently supports substantially the same proportionate amount of the load from overburden above the elevation of the retorts as is supported by the fragmented masses in such adjacent retorts for permitting substantially uniform subsidence of overburden above the gas barrier and above the fragmented masses;

establishing a combustion zone in at least one of such fragmented masses;

introducing an oxygen-supplying gas to such fragmented mass for sustaining the combustion zone and for advancing the combustion zone through such fragmented mass, and for retorting oil shale to produce liquid and gaseous products in a retorting zone on the advancing side of the combustion zone; and withdrawing such liquid and gaseous products from such a fragmented mass on the advancing side of the retorting zone.

2. The method according to claim 1 in which the gas barrier between adjacent fragmented masses yields structurally, but has sufficient structural integrity that it remains substantially unfragmented for a time interval at least as long as the active life of such adjacent retorts.

3. The method according to claim 1 wherein explosive is placed in a plurality of mutually spaced apart blasting holes located in such remaining portion of unfragmented formation within at least one of such retort sites; and wherein the thickness of the gas barrier is more than the burden distance of explosive in the blasting holes.

4. The method according to claim 3 wherein the thickness of the gas barrier is in the range of more than one to about 1.5 times the burden distance of such explosive.

5. The method according to claim 1 wherein explosive is placed in a plurality of mutually spaced apart blasting holes located in such remaining portion of unfragmented formation within at least one of such retort sites; and wherein the thickness of the gas barrier is more than the spacing distance of explosive in the blasting holes.

6. The method according to claim 5 wherein the thickness of the gas barrier is in the range of more than one to about 1.5 times the spacing distance of such explosive.

7. The method according to claim 1 wherein the gas barrier is sufficiently thin that subsidence of an upper portion of the gas barrier is substantially the same as subsidence of fragmented masses in adjacent retorts.

8. The method according to claim 1 wherein the gas barrier has a thickness greater than the spacing between most of the natural cleavage planes in the formation.

9. The method according to claim 1 wherein the gas barrier has a thickness at least about 50% greater than the maximum spacing of about $\frac{3}{4}$ of the natural cleavage planes in the formation.

10. The method according to claim 1 wherein the gas barrier has a thickness at least about 50% greater than a selected distance wherein at least about $\frac{3}{4}$ of the naturally occurring cleavage planes in the formation are spaced apart less than the selected distance.

11. A system of in situ oil shale retorts in a subterranean formation containing oil shale, each in situ oil shale retort containing a fragemented permeable mass of formation particles containing oil shale, and a gas barrier between an adjacent pair of such fragmented masses, the gas barrier comprising a vertically extending partition of substantially unfragmented formation that is sufficiently thick to inhibit substantial gas flow between the adjacent fragmented masses and sufficiently thin that the partition independently supports substantially the same proportionate amount of load from the overburden at elevations above the retorts as is supported by the fragmented masses in the adjacent retorts for permitting substantially uniform subsidence of overburden above the gas barrier and above the fragmented masses.

12. A system according to claim 11 wherein the partition is sufficiently thin that subsidence of an upper portion of the partition is substantially the same as subsidence of fragmented masses in adjacent retorts.

13. A system according to claim 11 wherein the gas barrier has a thickness at least about 50% greater than a selected distance wherein at least about $\frac{3}{4}$ of the naturally occurring cleavage planes in the formation are spaced apart less than the selected distance.

14. A system according to claim 11 in which the partition has sufficient structural integrity that it remains substantially unfragmented for a time interval at least as long as the active life of such adjacent retorts.

15. A system of in situ oil shale retorts in a subterranean formation containing oil shale, each in situ oil shale retort containing a fragmented permeable mass of formation particles containing oil shale, and a gas barrier between an adjacent pair of such fragmented masses, the gas barrier comprising a vertically extending partition of substantially unfragmented formation that is sufficiently thick to inhibit substantial gas flow between the adjacent fragmented masses and sufficiently thin that the partition yields structurally under load from the overburden at elevations above the retorts, without substantial fragmenting of the partition for permitting substantially uniform subsidence of overburden above the gas barrier and above the fragmented masses.

16. A system according to claim 15 in which the partition has sufficient structural integrity that it remains substantially unfragmented for a time interval at least as long as the active life of such adjacent retorts.

17. A system according to claim 15 wherein the partition is sufficiently thin that subsidence of an upper portion of the partition is substantially the same as subsidence of fragmented masses in adjacent retorts.

18. A system of in situ oil shale retorts in a subterranean formation containing oil shale, each of such in situ oil shale retorts being filled with a fragmented permeable mass of formation particles and separated from at least one adjacent in situ oil shale retort by a gas barrier in the form of a vertically extending partition of substantially unfragmented formation that is sufficiently thick to inhibit substantial gas flow between the adjacent retorts, and sufficiently thin that the partition supports only a portion of the load of overburden at elevations above the retorts with approximately the same proportionate amount of load being supported by such partition as by the fragmented masses in adjacent retorts for permitting uniform subsidence of overburden above the gas barrier and above such a fragmented mass.

19. A system according to claim 18 in which the partition has sufficient structural integrity that it remains substantially unfragmented for a time interval at least as long as the active life of such adjacent retorts.

20. A system of in situ oil shale retorts in a subterranean formation containing oil shale, each of such in situ oil shale retorts being filled with a fragmented permeable mass of formation particles and separated from at least one adjacent in situ oil shale retort by a gas barrier in the form of a vertically extending partition of substantially unfragmented formation that is sufficiently thick to inhibit substantial gas flow between the adjacent retorts, such a gas barrier being sufficiently thin that the partition yields structurally under load from the overburden at elevations above the retorts without fragmenting the partition form permitting substantially uniform subsidence of overburden above the gas barrier and above the fragmented masses.

21. A system according to claim 20 in which the partition has sufficient structural integrity that it remains substantially unfragmented for a time interval at least as long as the active life of such adjacent retorts.

22. A system of in situ oil shale retorts in a subterranean formation containing oil shale, each of such in situ oil shale retorts being filled with a fragmented permeable mass of formation particles and separated from at least one adjacent in situ oil shale retort by a gas barrier in the form of a vertically extending partition of substantially unfragmented formation that is sufficiently thick to inhibit substantial gas flow between the adjacent retorts and sufficiently thin that subsidence of an upper portion of the partition is substantially the same as subsidence of fragmented masses in adjacent retorts from permitting substantially uniform subsidence of overburden above the gas barrier and above the fragmented masses.

23. A system of in situ oil shale retorts in a subterranean formation containing oil shale, each of such in situ oil shale retorts being filled with a fragmented permeable mass of formation particles and separated from at least one adjacent in situ oil shale retort by a gas barrier in the form of a vertically extending partition of substantially unfragmented formation that has a thickness at least about 50% greater than a selected distance wherein at least about ¾ of the naturally occurring cleavage planes in the formation are spaced apart less than the selected distance, such a gas barrier being sufficiently thin that the partition yields structurally under load from the overburden at elevations above the retorts without fragmenting the partition.

24. A system of in situ oil shale retorts in a suberranean formation containing oil shale, each of such in situ oil shale retorts being filled with a fragmented permeable mass of formation particles and separated from at least one adjacent in situ oil shale retort by a gas barrier in the form of a vertically extending partition of substantially unfragmented formation having a thickness at least about 50% greater than the maximum spacing of about ¾ of the naturally occurring cleavage planes in the formation and sufficiently thin that subsidence of an upper portion of the partition is substantially the same as subsidence of fragmented masses in adjacent retorts.

25. A system of in situ oil shale retorts in a subterranean formation containing oil shale, each of such in situ oil shale retorts being filled with a fragmented permeable mass of formation particles and separated from at least one adjacent in situ oil shale retort by a gas barrier in the form of a vertically extending partition of unfragmented formation having a thickness greater than the spacing between most of the naturally occurring cleavage planes in the formation, such a partition being sufficiently thin that subsidence of an upper portion of the partition is substantially the same as subsidence of fragmented masses in adjacent retorts.

26. In a method for forming a plurality of in situ oil shale retorts in a subterranean formation containing oil shale, the improvement comprising explosively expanding formation within each of a pair of adjacent in situ oil shale retort sites for forming a fragmented permeable mass of formation particles containing oil shale in each of such adjacent in situ oil shale retort sites; and leaving a gas barrier between the pair of fragmented masses in the form of a vertically extending partition of substantially unfragmented formation which inhibits substantial gas flow between the fragmented masses and which yields structurally for supporting a proportionate amount of load from the overburden at elevations above the retorts that is not significantly greater than the amount of load supported by the fragmented masses in such adjacent retorts for permitting substantially uniform subsidence of overburden above the gas barrier and above the fragmented masses.

27. A method according to claim 26 including excavating at least one void in such an in situ oil shale retort site, leaving a zone of unfragmented formation in the retort site adjacent such a void; and placing explosive in a plurality of mutually spaced apart blasting holes in the zone of unfragmented formation, the thickness of the gas barrier being more than the burden distance of explosive in the blasting holes.

28. A method according to claim 27 where the thickness of the gas barrier is in the range of more than one to about 1.5 times the burden distance of such explosive.

29. A method according to claim 26 including excavating at least one void in such an in situ oil shale retort site, leaving a zone of unfragmented formation in the retort site adjacent such a void; and placing explosive in a plurality of mutually spaced apart blasting holes in the zone of unfragmented formation, the thickness of the gas barrier being more than the burden distance of explosive in adjacent spaced apart blasting holes located closest to the gas barrier.

30. A method according to claim 29 wherein the thickness of the gas barrier is in the range of more than one to about 1.5 times the burden distance of such explosive.

31. A method according to claim 26 including excavating at least one void in such an in situ oil shale retort site, leaving a zone of unfragmented formation in the retort site adjacent such a void; and placing explosive in a plurality of mutually spaced apart blasting holes in the zone of unfragmented formation, the thickness of the gas barrier being more than the spacing distance of explosive in the blasting holes.

32. A method according to claim 31 wherein the thickness of the gas barrier is in the range of more than one to about 1.5 times the spacing distance of such explosive.

33. A method according to claim 26 including excavating at least one void in such an in situ oil shale retort site, leaving a zone of unfragmented formation in the retort site adjacent such a void; and placing explosive in a plurality of mutually spaced apart blasting holes in the zone of unfragmented formation, the thickness of the gas barrier being more than the spacing distance of explosive in adjacent spaced apart blasting holes located closest to the gas barrier.

34. A method according to claim 33 wherein the thickness of the gas barrier is in the range of more than one to about 1.5 times the spacing distance of such explosive.

35. A method according to claim 26 including excavating a plurality of vertically spaced apart voids in such an in situ oil shale retort site, leaving at least one zone of unfragmented formation within the retort site between adjacent voids; and placing explosive in a plurality of vertically extending blasting holes spaced apart horizontally from each other in such zone of unfragmented formation, the thickness of the gas barrier being greater than the spacing distance of explosive in the blasting holes.

36. A method according to claim 26 wherein the gas barrier is sufficiently thin that subsidence of an upper portion of the partition is substantially the same as subsidence of the fragmented masses in adjacent retorts.

37. A method according to claim 26 wherein a gas barrier is left in place having a thickness greater than the spacing between most of the naturally occurring cleavage planes in the formation.

38. A method according to claim 26 wherein a gas barrier is left in place having a thickness at least about 50% greater than a selected distance wherein at least about ¾ of the naturally occurring cleavage planes in the formation are spaced apart less than the selected distance.

39. A method for forming a plurality of in situ oil shale retorts in a subterranean formation containing oil shale wherein each retort contains a fragmented permeable mass of formation particles containing oil shale, the method comprising the steps of:

excavating at least one void in each of a plurality of in situ oil shale retort sites leaving a remaining portion of unfragmented formation within each retort site adjacent such a void;

drilling a plurality of mutually spaced apart blasting holes in such remaining portion of unfragmented formation within such a retort site;

loading explosive into such blasting holes; and detonating such explosive for explosively expanding such remaining portion of formation towards such a void for forming a fragmented permeable mass of particles within such a retort and leaving a gas barrier in the form of a vertically extending partition of substantially unfragmented formation between such fragmented permeable mass and an adjacent retort site, the gas barrier having a thickness in the range of from about one to 1.5 times the burden distance of explosive in blasting holes located closest to the gas barrier.

40. A method according to claim 29 including drilling a plurality of vertically extending blasting holes in such remaining portion, loading explosive in such vertical blasting holes and detonating such explosive for explosive expansion, the gas barrier having a thickness greater than the burden distance of explosive in such vertical blasting holes closest to the gas barrier.

41. A method according to claim 39 including drilling a plurality of vertically extending blasting holes in such remaining portion, loading explosive in such vertical blasting holes and detonating such explosive for explosive expansion, the gas barrier having a thickness greater than the spacing distance of explosive in such vertical blasting holes closest to the gas barrier.

42. A method according to claim 39 including excavating a plurality of vertically spaced apart voids in such an in situ oil shale retort site, leaving at least one zone of unfragmented formation within the retort site between adjacent voids, and loading explosive in a plurality of vertically extending blasting holes spaced apart horizontally from each other in such zone of unfragmented formation, the thickness of the gas barrier being greater than the spacing distance of explosive in such blasting holes located closest to the gas barrier.

43. The method according to claim 39 wherein the gas barrier is sufficiently thin that subsidence of an upper portion of the partition is substantially the same as subsidence of fragmented masses in adjacent retorts.

44. A method for forming a plurality of in situ oil shale retorts in a subterranean formation containing oil shale while each retort contains a fragmented permeable mass of formation particles containing oil shale, the method comprising the steps of:

excavating at least one void in each of a plurality of in situ oil shale retort sites, leaving a remaining portion of unfragmented formation within each retort site adjacent such a void;

drilling a plurality of mutually spaced apart blasting holes in such remaining portion of unfragmented formation within such a retort site;

loading explosive into such blasting holes; and detonating such explosive for explosively expanding such remaining portion of formation towards such a void for forming a fragmented permeable mass of particles within such a retort and leaving a gas barrier in the form of a vertically extending partition of substantially unfragmented formation between such fragmented permeable mass and an adjacent retort site, the gas barrier having a thickness in the range of from about one to 1.5 times the spacing distance of explosive in blasting holes located closest to the gas barrier.

45. A method according to claim 44 including drilling a plurality of vertically extending blasting holes in such remaining portion, loading explosive in such vertical blasting holes and detonating such explosive for explosive expansion, the gas barrier having a thickness greater than the burden distance of explosive in such vertical blasting holes closest to the gas barrier.

46. A method according to claim 44 including drilling a plurality of vertically extending blasting holes in such remaining portion, loading explosive in such vertical blasting holes and detonating such explosive for explosive expansion, the gas barrier having a thickness greater than the spacing distance of explosive in such vertical blasting holes closest to the gas barrier.

47. A method according to claim 44 including excavating a plurality of vertically spaced apart voids in such an in situ oil shale retort site, leaving at least one zone of unfragmented formation within the retort site between adjacent voids; and loading explosive in a plurality of vertically extending blasting holes spaced apart horizontally from each other in such zone of unfragmented formation, the thickness of the gas barrier being greater than the spacing distance of explosive in such blasting holes closest to the gas barrier.

48. A method according to claim 44 including excavating a plurality of vertically spaced apart voids in such an in situ oil shale retort site, leaving at least one zone of unfragmented formation within the retort site between adjacent voids; and loading explosive in a plurality of vertically extending blasting holes spaced apart horizontally from each other in such zone of unfragmented formation, the thickness of the gas barrier being greater than the burden distance of explosive in such blasting holes.

49. A method according to claim 44 wherein the gas barrier is sufficiently thin that subsidence of an upper portion of the gas barrier is substantially the same as subsidence of fragmented masses in adjacent retorts.

50. A method for forming a plurality of in situ oil shale retorts in a subterranean formation containing oil shale, wherein each of a pair of adjacent first and second retorts contains a fragmented permeable mass of formation particles containing oil shale, and wherein such adjacent retorts are separated by a gas barrier in the form of a vertically extending partition of substantially unfragmented formation, the method comprising the steps of:

excavating at least one void within the retort site of a first one of such adjacent in situ retorts, and leaving a remaining portion of unfragmented formation within the first retort site adjacent the void;

placing explosive in a plurality of mutually spaced apart blasting holes in the remaining portion of unfragmented formation within the first retort site; and detonating such explosive to explosively expand the remaining portion of unfragmented formation toward such a void for forming a fragmented permeable mass of formation particles containing oil shale in such first in situ oil shale retort, and leaving a gas barrier in the form of a vertically extending partition of substantially unfragmented formation between the fragmented mass in the first in situ retort and a fragmented permeable mass of formation particles containing oil shale in an adjacent second in situ oil shale retort, the gas barrier being sufficiently thick to inhibit substantial gas flow between the adjacent fragmented masses, the gas barrier also being sufficiently thin that it supports proportionately about the same amount of load from the overburden at elevations above the retorts as is supported by the adjacent fragmented masses for permitting substantially uniform subsidence of overburden above the gas barrier and above the fragmented masses.

51. The method according to claim 50 wherein the gas barrier has a thickness of more than the spacing distance of explosive in the blasting hole prior to the explosive expansion step.

52. The method according to claim 50 wherein the thickness of the gas barrier is in the range of more than one to about 1.5 times the spacing distance of explosive in the blasting holes.

53. The method according to claim 50 wherein the gas barrier has a thickness of more than the burden distance of explosive in the blasting holes prior to the explosive expansion step.

54. The method according to claim 53 wherein the thickness of the gas barrier is in the range of more than one to about 1.5 times the burden distance of explosive in the blasting holes.

55. The method according to claim 50 wherein the gas barrier has an average thickness of more than the spacing distance of explosive in adjacent blasting holes in a row of blasting holes parallel to the length of the gas barrier and located nearer the gas barrier than other blasting holes in such remaining portion.

56. The method according to claim 50 wherein the gas barrier has an average thickness of more than the burden distance of explosive in adjacent blasting holes in a row of blasting holes parallel to the length of the gas barrier and located nearer the gas barrier than other blasting holes in such remaining portion.

57. A method according to claim 50 include excavating a plurality of vertically spaced apart voids in such a first in situ oil shale retort site, leaving at least one zone of unfragmented formation within the retort site between adjacent voids; and placing explosive in a plurality of vertically extending blasting holes spaced apart horizontally from each other in such zone of unfragmented formation, the thickness of the gas barrier being greater than the burden distance of explosive in such blasting holes closest to the gas barrier.

58. In a method for forming a plurality of in situ oil shale retorts in a subterranean formation containing oil shale, the improvement comprising explosively expanding formation within each of a pair of adjacent in situ oil shale retort sites for forming a fragmented permeable mass of formation particles containing oil shale in each of such adjacent in situ oil shale retort sites; and leaving a gas barrier between a pair of fragmented masses in the form of a vertically extending partition of substantially unfragmented formation which inhibits substantial gas flow between the fragmented masses and which is sufficiently thin that subsidence of an upper portion of the partition is substantially the same as subsidence of the fragmented masses in the adjacent retort sites for permitting substantially uniform subsidence of overburden above the gas barrier and above the fragmented masses.

59. The method according to claim 58 wherein such a gas barrier has a thickness at least about 50% greater than a selected distance wherein at least about $\frac{3}{4}$ of the naturally occurring cleavage planes in the formation are spaced apart less than the selected distance.

60. In a method for forming a plurality of in situ oil shale retorts in a subterranean formation containing oil shale, the improvement comprising explosively expanding formation within each of a pair of adjacent in situ oil shale retort sites for forming a fragmented permeable mass of formation particles containing oil shale in each of such adjacent in situ oil shale retort sites, the pair of fragmented masses being spaced apart by a gas barrier in the form of a vertically extending partition of substantially unfragmented formation which has a thickness greater than the spacing between most of the cleavage planes in the formation and which yields structurally for supporting a proportionate amount of load from the overburden at elevations above the retorts that is not significantly greater than the amount of load supporting by the fragmented masses in such adjacent retorts.

61. The method according to claim 60 wherein the gas barrier is sufficiently thin that subsidence of an upper portion of the partition is substantially the same as subsidence of fragmented masses in the adjacent retorts.

* * * * *

UNITED STATES PATENT AND TRADEMARK OFFICE

CERTIFICATE OF CORRECTION

PATENT NO. : 4,176,882

DATED : December 4, 1979

INVENTOR(S) : Irving G. Studebaker, Ned M. Hutchins

It is certified that error appears in the above-identified patent and that said Letters Patent are hereby corrected as shown below:

Column 1, line 21, "formation" should be -- formation --.
Column 6, line 15, "partilces" should be -- particles --.
Column 9, line 51, delete "the" before "areas".
Column 10,line 54, "plan" should be -- plane --.
Column 11,line 11, "of" (third occurrence) should be -- to --.
Column 13,line 66, "fragemented" should be -- fragmented --.
Column 15,line 66, "fragemented" should be -- fragmented --.
Column 17,line 7, "form" should be -- for --;
Column 17,line 44, "suberranean" should be -- subterranean --.
Column 19,line 49, "29" should be -- 39 --.
Column 20,line 11, "while" should be -- wherein --.
Column 22,line 26, "a"(second occurrence) should be -- the --;
Column 22,line 55, "supporting" should be -- supported --.

Signed and Sealed this

*Twenty-ninth* Day of *April 1980*

[SEAL]

*Attest:*

SIDNEY A. DIAMOND

*Attesting Officer*

*Commissioner of Patents and Trademarks*